US007314183B2

(12) United States Patent
Zuccaro

(10) Patent No.: US 7,314,183 B2
(45) Date of Patent: Jan. 1, 2008

(54) SQUIRT RESISTANT AND SPILL RESISTANT STRAW/FLUID DELIVERY PASSAGE

(76) Inventor: Dante Cataldo Zuccaro, 2374 Addison Hills Ct., Oxford, MI (US) 48370

( * ) Notice: Subject to any disclaimer, the term of this patent is extended or adjusted under 35 U.S.C. 154(b) by 0 days.

(21) Appl. No.: 11/352,765

(22) Filed: Feb. 13, 2006

(65) Prior Publication Data

US 2006/0131438 A1 Jun. 22, 2006

Related U.S. Application Data

(62) Division of application No. 10/841,026, filed on May 7, 2004, now Pat. No. 7,011,255.

(60) Provisional application No. 60/468,869, filed on May 8, 2003.

(51) Int. Cl.
*A47G 21/18* (2006.01)

(52) U.S. Cl. ..... 239/33; 239/24; 239/16; 220/705; 220/706; 229/103.1; 215/388; D7/300.2

(58) Field of Classification Search ..... 239/33; 446/200, 201; 210/435, 436, 321.76, 321.85, 210/448
See application file for complete search history.

(56) References Cited

U.S. PATENT DOCUMENTS 3,834,068 A * 9/1974 Fabricant ..... 446/74
4,658,990 A 4/1987 Ramage
4,714,173 A 12/1987 Ruiz
4,726,518 A 2/1988 Martina et al.
5,186,353 A 2/1993 Ramsey
5,201,460 A 4/1993 Caines
5,273,172 A 12/1993 Rossbach et al.
5,462,194 A 10/1995 Barnwell
5,465,866 A 11/1995 Belcastro
5,702,025 A 12/1997 Di Gregorio
5,772,880 A * 6/1998 Lynn et al. ..... 210/435
5,813,604 A 9/1998 Frassetti
5,850,908 A 12/1998 Jasek
5,873,478 A 2/1999 Sullivan et al.
5,890,619 A 4/1999 Belanger
5,890,620 A 4/1999 Belcastro
6,050,444 A 4/2000 Sugg
6,112,919 A 9/2000 Ho
6,135,311 A 10/2000 Panec et al.
6,234,342 B1 5/2001 Cornell et al.
6,503,222 B2 * 1/2003 Lo ..... 604/77
6,579,141 B2 * 6/2003 Bayliss ..... 446/200

* cited by examiner

*Primary Examiner*—Dinh Q. Nguyen
(74) *Attorney, Agent, or Firm*—Warn Partners, P.C.

(57) ABSTRACT

A spill or squirt resistant fluid management system is described. The system primarily includes: (1) a first fluid passage portion having a first open end; (2) a second fluid passage portion having a second open end; (3) a fluid accumulator portion disposed between, and in fluid communication with, the first and second fluid passage portions; (4) a fluid inlet disposed between the second fluid passage portion and the fluid accumulator portion; and (5) a fluid exit disposed between the first fluid passage portion and the fluid accumulator portion. The system is useful for incorporation into drinking straws, fluid containers, drinking container lids, and tanker trucks.

10 Claims, 7 Drawing Sheets

SQUIRT RESISTANT AND SPILL RESISTANT STRAW/FLUID DELIVERY PASSAGE

CROSS-REFERENCE TO RELATED APPLICATION

The instant application is a division of U.S. patent application Ser. No. 10/841,026, filed May 7, 2004 now U.S. Pat. No. 7,011,255, and claims priority to U.S. Provisional Patent Application Ser. No. 60/468,869, filed May 8, 2003, the entire specification of both of which are expressly incorporated herein by reference.

FIELD OF THE INVENTION

The present invention generally relates to drinking straws, and more particularly to squirt resistant and spill resistant drinking straws, fluid delivery passages, and containers.

BACKGROUND OF THE INVENTION

Conventional drinking straws suffer from several disadvantages, one of which is the tendency for a fluid to easily squirt or spill from the straw that is utilized to deliver the fluid from a fluid reservoir, such as juice bags, juice boxes, drinking containers (e.g., bottles, cans, and the like), other various types of fluid supplies, and the like. This unwanted fluid flow typically occurs while installing the straw into the container or during handling the container.

Various devices and methods have been proposed for preventing squirting and/or spilling from drinking straws, fluid containers, and caps for fluid containers, including those disclosed in U.S. Pat. No. 4,714,173 to Ruiz; U.S. Pat. No. 5,186,353 to Ramsey; U.S. Pat. No. 5,201,460 to Caines; U.S. Pat. No. 5,273,172 to Rossbach et al.; U.S. Pat. No. 5,462,194 to Barnwell; U.S. Pat. No. 5,465,866 to Belcastro; U.S. Pat. No. 5,702,025 to Di Gregorio; U.S. Pat. No. 5,850,908 to Jasek; U.S. Pat. No. 5,873,478 to Sullivan et al.; U.S. Pat. No. 5,890,619 to Belanger; U.S. Pat. No. 5,890,620 to Belcastro; U.S. Pat. No. 6,050,444 to Sugg; U.S. Pat. No. 6,112,919 to Ho; and U.S. Pat. No. 6,135,311 to Panec et al., the entire specifications of which are expressly incorporated herein by reference.

However, these devices and methods suffer from several disadvantages. For example, some of these methods employ closing a passage for fluid flow by displacing a straw tip that causes the straw to fold or a valve to close. These methods also typically require a special container and require the consumer to "activate" the straw/delivery passage to open and close the fluid passage. Additionally, these methods do not resist squirting or spilling while the straw/delivery passage is in the "open" or "useable" position.

Other methods require a consumer to "activate" or displace the straw to stop fluid flow, and perform a similar function to regain fluid flow. Again, these methods do not resist squirting or spilling while the straw is in the "open" or "useable" position.

Devices such as valve assemblies have been proposed as a means for preventing any spillage from a container. However, these designs require a complicated multi-component apparatus. Further, these designs require that a consumer activate a valve to prevent spillage and reactivate the valve to regain fluid flow. Again, these devices do not resist squirting or spilling while the fluid passage is in the "open" or "useable" position and thus may require a special container. These devices are generally not feasible in a conventional straw construction.

Other devices employ complicated "passive" valve assemblies that do not require conscious activation. However, all of these devices typically require multiple components and require a special container. Also, additional vacuum (e.g., negative pressure) may be required to activate some of these devices in order to initiate fluid flow, and this may be undesirable from the consumer's standpoint. These devices are generally not feasible in a conventional straw construction.

Accordingly, there exists a need for new and improved drinking straws, fluid delivery passages, and containers, including those that are resistant to squirting and spilling of fluids.

SUMMARY OF THE INVENTION

In accordance with the general teachings of the present invention, a new and improved drinking straw having a fluid reservoir formed therein is provided, wherein the drinking straw permits delivery of a fluid from any type of reservoir, including juice bags, juice boxes, drinking containers, fluid supplies, and the like, wherein the drinking straw is substantially squirt resistant and spill resistant.

Furthermore, this invention relates to a method and apparatus to allow fluid to flow conveniently through a straw when a vacuum is applied to the straw exit/consumer end (i.e., the end opposite of the reservoir). Yet, when a disturbance is applied to the fluid reservoir, typically from collapsing the fluid reservoir causing fluid displacement (e.g., squeezing a juice box/bag or the like), or from acceleration (e.g., shaken by hand during walking, running, or riding in a vehicle) the fluid will not easily exit (e.g., squirt or spill) through the straw.

More specifically, the present invention provides a new and improved drinking straw having a typically thin-walled cylindrical hollow construction having two spaced and opposed ends, with an accumulator portion located therebetween. As fluid is forced through the straw due to a disturbance (e.g., squeezing a collapsible container) the fluid is pushed into the accumulator portion. Without being bound to a particular theory of the operation of the present invention, the fluid travels in a specified motion in the accumulator due to the accumulator's geometry and entrance direction into the accumulator. The direction of the fluid creates momentum that is not favorable to travel into the accumulator exit which will: (a) eliminate any fluid from exiting the straw until the accumulator is full or at least nearly full; (b) eliminate fluid from exiting due to fluid momentum alone; and (c) resists fluid exiting when the accumulator reaches capacity. Therefore, the disturbed fluid will not freely exit the exit end/consumer end of the straw as it would in a conventional drinking straw design.

Moreover, the present invention provides an apparatus and method that allows fluid to flow easily when required, and does not necessitate that the consumer performs any additional or unique tasks in order to benefit from the squirt resistant and spill resistant fluid delivery system. Yet, the design is simple, consists of only one piece and is inexpensive to manufacture. This design results in a beneficial squirt/spill resistant function that is completely passive.

In accordance with a first embodiment of the present invention, a spill or squirt resistant fluid management system is provided, comprising: (1) a first fluid passage portion having a first open end; (2) a second fluid passage portion having a second open end; (3) a fluid accumulator portion disposed between, and in fluid communication with, the first and second fluid passage portions; (4) a fluid inlet disposed between the second fluid passage portion and the fluid accumulator portion; and (5) a fluid exit disposed between the first fluid passage portion and the fluid accumulator portion.

In accordance with a second embodiment of the present invention, a spill or squirt resistant fluid management system is provided, comprising: (1) a first fluid passage portion having a first open end; (2) a second fluid passage portion having a second open end; (3) a fluid accumulator portion disposed between, and in fluid communication with, the first and second fluid passage portions, wherein the fluid accumulator portion has a first cross-sectional area; (4) a fluid inlet disposed between the second fluid passage portion and the fluid accumulator portion, wherein the fluid inlet has a second cross-sectional area; and (5) a fluid exit disposed between the first fluid passage portion and the fluid accumulator portion, wherein the fluid exit has a third cross-sectional area, wherein the first cross-sectional area is substantially equal to or greater than either the second or third cross-sectional areas.

In accordance with a third embodiment of the present invention, a spill or squirt resistant fluid management system is provided, comprising: (1) a first fluid passage portion having a first open end; (2) a second fluid passage portion having a second open end; (3) a fluid accumulator portion disposed between, and in fluid communication with, the first and second fluid passage portions, wherein the fluid accumulator portion has a first cross-sectional area; (4) a fluid inlet disposed between the second fluid passage portion and the fluid accumulator portion, wherein the fluid inlet has a second cross-sectional area; and (5) a fluid exit disposed between the first fluid passage portion and the fluid accumulator portion, wherein the fluid exit has a third cross-sectional area, wherein the first cross-sectional area is substantially equal to or greater than either the second or third cross-sectional areas, wherein one of the fluid inlet or the fluid exit are angled with respect to the fluid accumulator portion.

In accordance with a fourth embodiment of the present invention, a spill or squirt resistant fluid management system is provided, comprising: (1) a first fluid passage portion having a first open end; (2) a second fluid passage portion having a second open end; (3) a fluid accumulator portion disposed between, and in fluid communication with, the first and second fluid passage portions; (4) a fluid inlet disposed between the second fluid passage portion and the fluid accumulator portion; and (5) a fluid exit disposed between the first fluid passage portion and the fluid accumulator portion, wherein a fluid flow through the fluid accumulator portion towards the fluid exit is substantially impeded.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
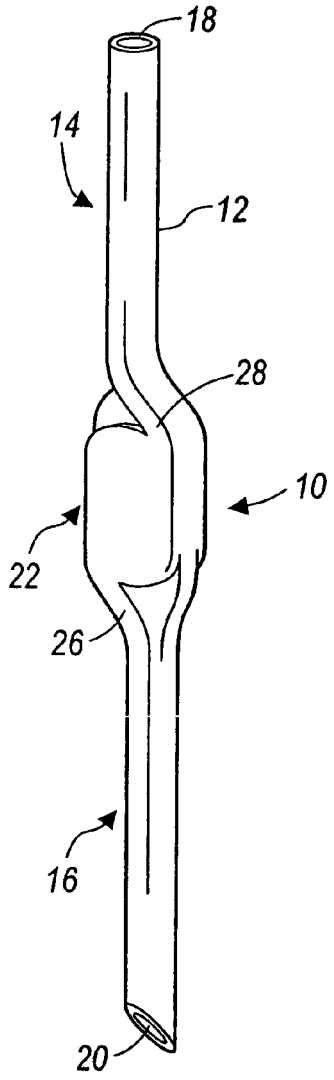
FIG. 1 depicts a perspective view of a drinking straw, in accordance with one embodiment of the present invention.

The following description of the preferred embodiment(s) is merely exemplary in nature and is in no way intended to limit the invention, its application, or uses.

Referring to FIGS. 1-4E, there is shown a drinking straw 10, in accordance with one embodiment of the present invention. The straw 10 preferably includes a substantially cylindrical hollow body 12. The body 12 is preferably comprised of a plastic material that is suitable for the construction of drinking straws, as is known in the art. By way of a non-limiting example, the straw 10 can be manufactured via blow molding or by an extrusion process with inline formations of non-typical shapes after the extrusion head (e.g., as in the manufacturing of corrugated tubing and some straws). Many materials are suitable for this application, including but not limited to food grade high density polyethylene (HDPE), food grade Low Density Polyethylene (LDPE), food grade polypropylene, or any other food grade materials typically used in straw construction. If the particular application were not intended for consumer use, the food grade specification of the material would not be necessary.

The exact thickness of the walls of the body 12, are not thought to be critical to the success of the present invention; however, it is preferred that the walls are relatively thin so as to reduce the weight and cost of the straw 10, as well as to provide a degree of flexibility thereto.

The body 12 is preferably unitary in construction, i.e., a one-piece design, and preferably includes an upper fluid passage portion 14, a lower fluid passage portion 16, spaced and opposed first and second open ends, 18, 20, respectively, and a fluid accumulator portion 22 disposed therebetween. It should be noted that the terms "upper" and "lower" are for orientation purposes only, and the straw 10 may be used in an acceptable manner if it were to be inverted. Preferably, the upper fluid passage portion 14, lower fluid passage portion 16, and accumulator portion 22 are in fluid communication with one another, so that a fluid can flow therethrough.

Figure 2:
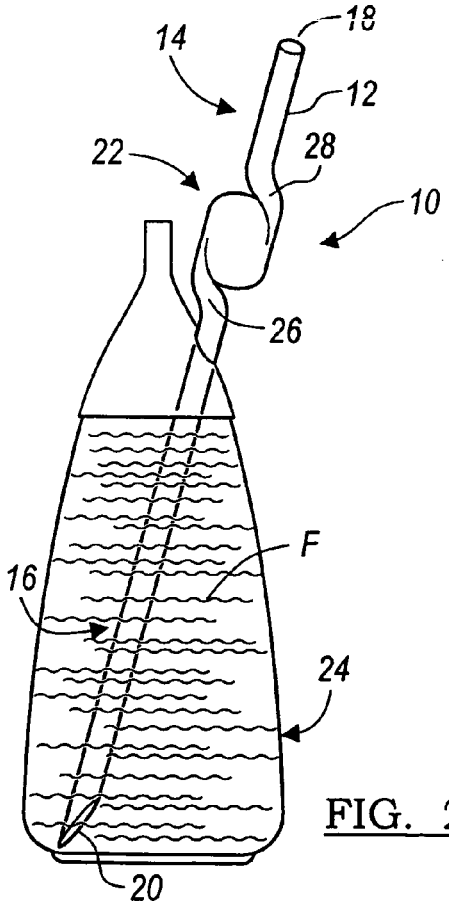
FIG. 2 depicts an elevational view of the drinking straw depicted in FIG. 1 in a fluid reservoir, in accordance with one embodiment of the present invention.

The first open end 18 preferably used by an individual in order to receive fluid from a container, e.g., by an individual sucking (i.e., applying vacuum) on the first open end 18 with his/her lips. The second open end 20 is preferably submerged within a fluid container 24 (as shown in FIG. 2) in order to access the fluid F to be removed through the straw 10. Although the second open end 20 is shown as being angled, it should be appreciated that the second open end 20 can be configured in any number of configurations. It should be noted that the straw 10 of the present invention could be practiced with any type of fluid container.

Figure 3:
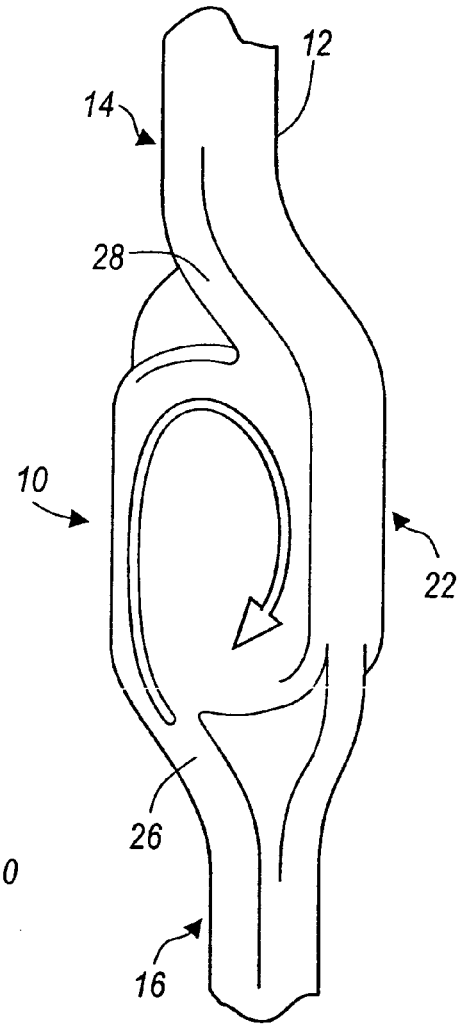
FIG. 3 depicts a partial perspective view of an accumulator section of the drinking straw depicted in FIG. 1.
Figure 4:
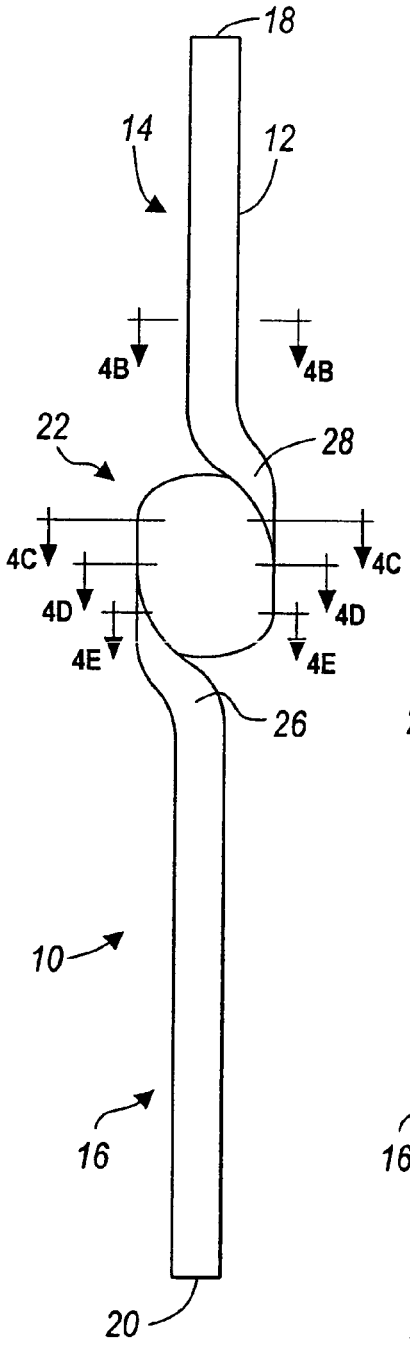
FIG. 4 depicts an elevational view of the drinking straw depicted in FIG. 1, in accordance with one embodiment of the present invention.
Figure 4A:
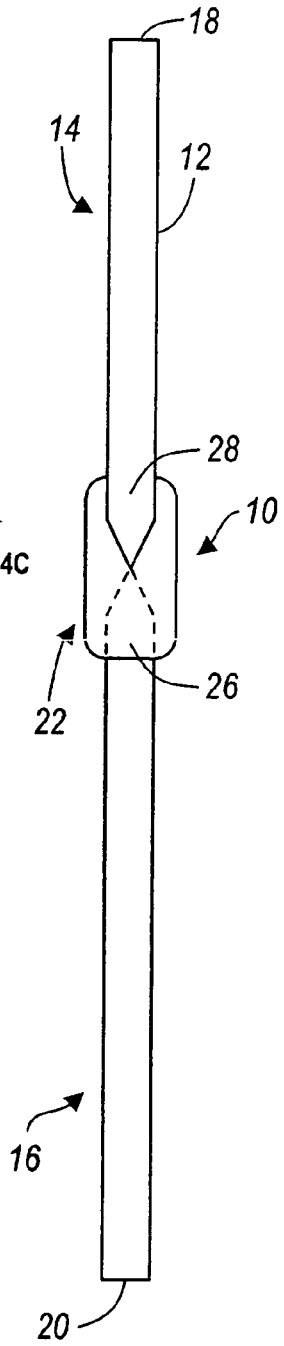
FIG. 4A depicts a side view of the drinking straw depicted in FIG. 1, in accordance with one embodiment of the present invention.
Figure 4B:
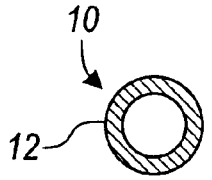
FIG. 4B depicts a sectional view taken along line 4B-4B of FIG. 4.
Figure 4C:
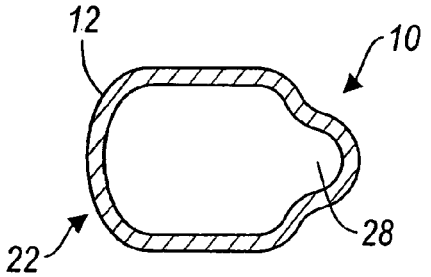
FIG. 4C depicts a sectional view taken along line 4C-4C of FIG. 4.
Figure 4D:
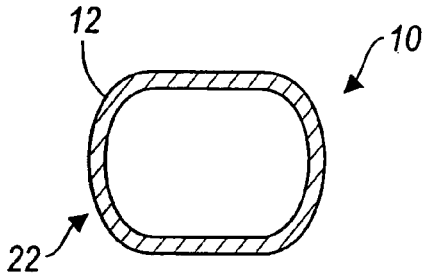
FIG. 4D depicts a sectional view taken along line 4D-4D of FIG. 4.
Figure 4E:
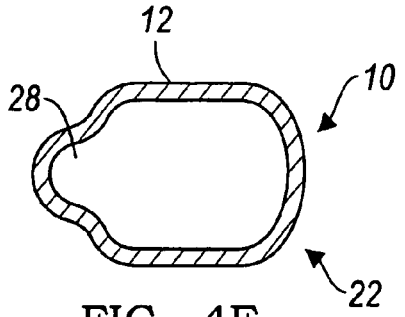
FIG. 4E depicts a sectional view taken along line 4E-4E of FIG. 4.

Referring specifically to FIGS. 3-4A, the accumulator portion 22 is substantially hollow and includes an area of increased cross-sectional area and/or volume as compared to either the upper fluid passage portion 14 or the lower fluid passage portion 16 (see FIGS. 4B-4E). It should be noted that the area, volume and/or shape of the accumulator portion 22 could be modified so as to size or tune the accumulator portion 22 for specific applications in order to achieve optimum performance. Furthermore, the exact location of the accumulator portion 22, relative to the other portions of the straw 10 is not thought to be critical to the success of the present invention, provided that it could still aid in the spill and/or squirt resistant nature of the straw 10. By way of a non-limiting example, the accumulator portion 22 is preferably located such that it is above the level of the fluid to be ingested. In accordance with a preferred embodiment of the present invention, the accumulator portion 22 is located equidistantly between the first and second open ends 18, 20, respectively. It will be readily appreciated that the accumulator portion 22 may be positioned other than equidistantly. Like the other portions of the straw 10, the accumulator portion 22 is preferably comprised of relatively thin walls.

The accumulator portion 22 preferably includes a fluid inlet 26 in fluid communication with the lower fluid passage portion 16 and a fluid exit 28 in fluid communication with the upper fluid passage portion 14. In accordance with a preferred embodiment of the present invention, the fluid inlet 26 is preferably curved or angled with respect to the lower fluid passage portion 16 and the fluid exit 28 is preferably curved or angled with respect to the upper fluid passage portion 14. In accordance with a preferred embodiment of the present invention, the fluid inlet 26 and/or fluid exit 28 are preferably provided with a relatively substantially equal or smaller cross-sectional profile (e.g., area and/or volume) as compared to that of the accumulator portion 22. In accordance with another preferred embodiment of the present invention, the accumulator portion 22 is preferably provided with an internal volume that is preferably substantially equal to or greater than the internal volumes of either the fluid inlet 26 and/or the fluid exit 28.

Without being bound to a particular theory of the operation of the present invention, it is thought that by constructing the fluid exit 28 and/or accumulator portion 22 in such a configuration so as not to direct fluid flow directly toward the fluid exit 28, the probability of fluid being undesirably expelled or squirted upwardly (e.g., during a fluid disturbance) towards the first open end 18 will be greatly reduced or eliminated. That is, if the fluid container 24 is squeezed, any upwardly flowing fluid that reaches the area proximate to the fluid exit 28 of the accumulator portion 22 would tend to fall back towards the accumulator portion and/or the fluid inlet 26, as opposed to continuing upwardly towards the upper fluid passage portion 14, as specifically shown by the arrow in FIG. 3. By way of a non-limiting example, the fluid inlet 26 and the fluid exit 28 are preferably spaced and substantially diagonally opposed from one another so as to cause any fluid flow therebetween to be along a tortuous path, i.e., the fluid flow should not easily pass through the accumulator portion 22 and then immediately up through the upper fluid passage portion 14. In this manner, the flow of the fluid F is at least substantially impeded from flowing through and/or out of the accumulator portion 22 and into the fluid exit 28 and ultimately towards the upper fluid passage portion 14.

By way of a non-limiting example, as a disturbance (e.g., squeezing a collapsible container or acceleration input) is applied to the fluid container 24, the fluid will travel up the lower fluid passage portion 16 and enter the accumulator portion 22 through the fluid inlet 26. The direction of the fluid flow then changes because it is constrained to follow the geometry of the accumulator portion 22. The fluid flow has momentum in a direction that is not directed toward the fluid exit 28. As a result, this will eliminate any significant amount of fluid from entering the fluid exit 28 until the accumulator portion 22 is full or at least nearly full. Because the fluid flow momentum is in a direction that is not favorable to exit the accumulator portion 22, the fluid will not have a tendency to rush or travel into the fluid exit 28 or the upper fluid passage portion 14. Accordingly, the accumulator portion 22 would have to be filled to capacity, or near capacity, before any significant amount of fluid F will proceed towards the upper fluid passage portion 14. The present invention thus creates a non-direct, tortuous path for the disturbed fluid to travel prior to having an opportunity to exit the accumulator portion 22.

The present invention is in contradistinction to a conventional drinking straw, wherein disturbed fluid is constrained to follow the inside of the straw, which does not present a tortuous path, but rather the fluid is easily guided to the straw exit with little loss in momentum/velocity due to the straw's uniformly cylindrical geometry along the entire length thereof.

It should be appreciated, however, that a sufficient amount of suction, e.g., when an individual sucks on the first open end 18, will nonetheless allow the fluid F to travel upwardly through the fluid exit 28 and the upper fluid passage portion 14, despite the spill and squirt resistant configuration of the accumulator portion 22.

By way of a non-limiting example, when fluid F is demanded by applying a vacuum (e.g., negative pressure) to the first open end 18, the process for fluid delivery, from a consumer's perspective, is exactly the same as a conventional straw application without squirt or spill resistance. As the vacuum is applied, the fluid F is drawn upwardly through the lower fluid passage portion 16 and enters and fills the accumulator portion 22. As the accumulator portion 22 is filled sufficiently, the height of the fluid F will rise and enter the fluid exit 28, then travel through the upper fluid passage portion 14 and exit at the first open end 18.

After normal use, or after a disturbance to said the fluid container 24, any residual fluid in the upper fluid passage portion 14, the fluid exit 28, and most, if not all, of the fluid F in the accumulator portion 22, will be assisted back into the fluid container 24 by the force of gravity.

By way of a non-limiting example, in order to improve the aesthetic presentation of the accumulator portion, especially in the areas of the fluid inlet 26 and/or the fluid exit 28, or to improve packaging, or to enhance function, a corrugated portion (e.g., a selectively operable flexible accordion section) may be provided at any location, either before and/or after the accumulator portion 22. Furthermore, the corrugated portion can also be incorporated into the accumulator portion 22 as well.

Figure 5:
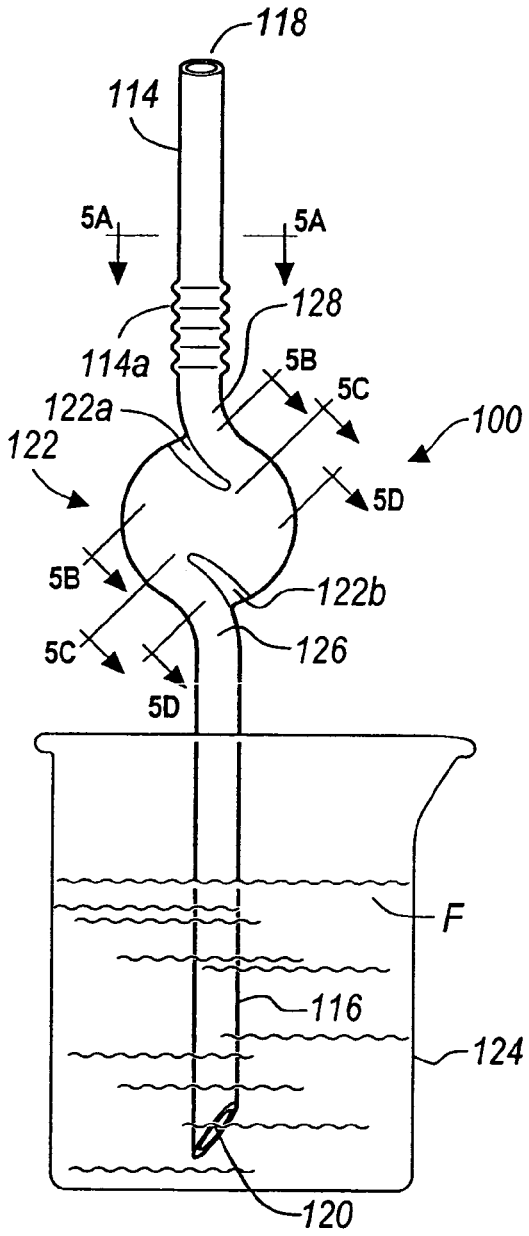
FIG. 5 depicts an elevational view of a first alternative drinking straw, in accordance with a second embodiment of the present invention.
Figure 5A:
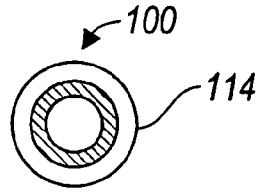
FIG. 5A depicts a sectional view taken along line 5A-5A of FIG. 5.
Figure 5B:
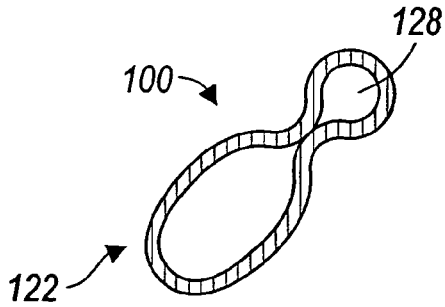
FIG. 5B depicts a sectional view taken along line 5B-5B of FIG. 5.
Figure 5C:
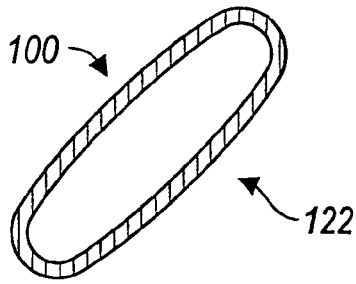
FIG. 5C depicts a sectional view taken along line 5C-5C of FIG. 5.
Figure 5D:
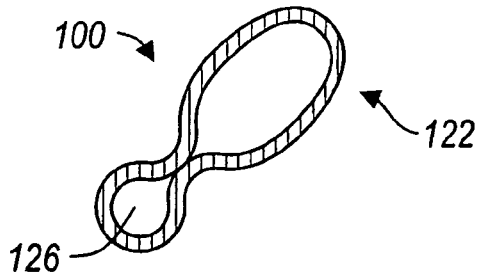
FIG. 5D depicts a sectional view taken along line 5D-5D of FIG. 5.

Referring to FIGS. 5-5D, there is shown a first alternative drinking straw 100, in accordance with a second embodiment of the present invention. The straw 100 is somewhat similar (e.g., in construction, materials, and method of manufacture) to the straw 10 depicted in FIGS. 1-4E, except for the fact that the accumulator portion 122 has been modified and a flexible accordion portion 114*a* has been incorporated into the upper fluid passage portion 114 (e.g., for allowing a section of the upper fluid passage portion 114 to bend). In accordance with a preferred embodiment of the present invention, the fluid inlet 126 and/or fluid exit 128 are preferably provided with a relatively equal or smaller cross-sectional profile as compared to the accumulator portion 122. Thus, although the cross-sectional area and/or volume of the accumulator portion 122 is still larger than the corresponding cross-sectional area and/or volume of either the lower fluid passage portion 116 and/or the upper fluid passage portion 114, it is smaller than that of the embodiment depicted in FIGS. 1-4E. The variation in area and/or volume can be accomplished by incorporating baffle members 122*a*, 122*b*, respectively, into the accumulator portion 122. The baffle members 122*a*, 122*b*, respectively, can be configured in any number of shapes. Baffle members can also be utilized to direct fluid in a predetermined direction and/or improve aesthetics.

As with the previously described embodiment, the straw 100 is intended to remove fluid F from a container 124, by having the user apply suction on the first open end 118 so that the fluid F flows upwardly through the second open end 120, into the lower fluid passage portion 116, into the fluid inlet 126, through the accumulator portion 122, through the fluid exit 128, through the upper fluid passage portion 114, and eventually out through the first open end 118.

Figure 6:
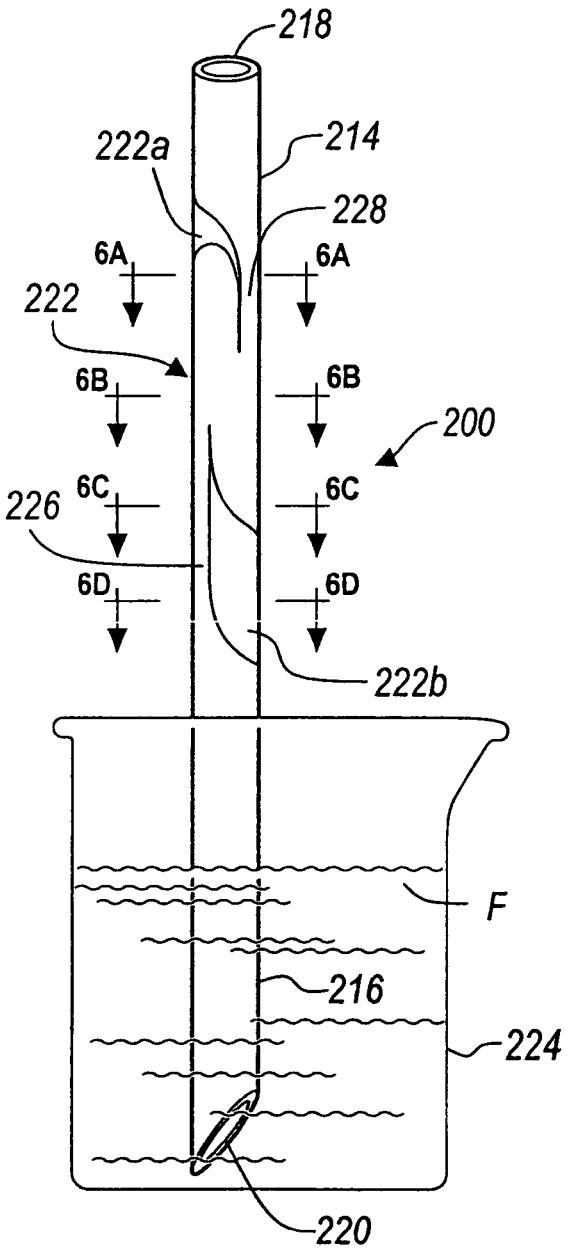
FIG. 6 depicts an elevational view of a second alternative drinking straw in a fluid reservoir, in accordance with a third embodiment of the present invention.
Figure 6A:
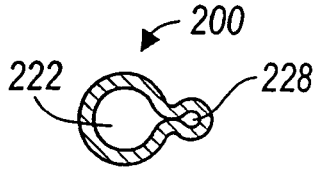
FIG. 6A depicts a sectional view taken along line 6A-6A of FIG. 6.
Figure 6B:
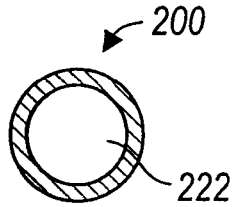
FIG. 6B depicts a sectional view taken along line 6B-6B of FIG. 6.
Figure 6C:
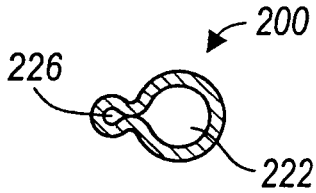
FIG. 6C depicts a sectional view taken along line 6C-6C of FIG. 6.
Figure 6D:
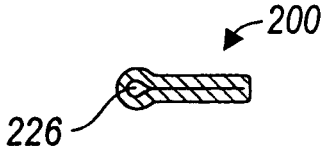
FIG. 6D depicts a sectional view taken along line 6D-6D of FIG. 6.

Referring to FIGS. 6-6D, there is shown a second alternative drinking straw 200, in accordance with a third embodiment of the present invention. The straw 200 is somewhat different from the embodiments depicted in FIGS. 1-5D; however, it does share some similar features, such as an upper fluid passage portion 214, a lower fluid passage portion 216, first open end 218, and second open end 220. The accumulator portion 222 is rather different from the previously described embodiments, as it does not extend radially outwardly from the central axis of the straw 200. In accordance with a preferred embodiment of the present invention, the fluid inlet 226 and/or fluid exit 228 are preferably provided with a relatively equal or smaller cross-sectional profile as compared to the accumulator portion 222. Thus, although the cross-sectional area and/or volume of the accumulator portion 222 is substantially equivalent to the corresponding cross-sectional area and/or volume of either the lower fluid passage portion 216 and/or the upper fluid passage portion 214, the overall fluid volume capacity of the accumulator 222 is suitable for accomplishing the aims of the invention, i.e. spill and squirt resistance. The variation in area and/or volume can be accomplished by incorporating baffle members 222*a*, 222*b*, respectively, into the accumulator portion 222. The baffle members 222*a*, 222*b*, respectively, can be configured in any number of shapes. Baffle members can also be utilized to direct fluid in a predetermined direction and/or improve aesthetics.

As with the previously described embodiments, the straw 200 is intended to remove fluid F from a container 224, by having the user apply suction on the first open end 218 so that the fluid F flows upwardly through the second open end 220, into the lower fluid passage portion 216, into the fluid inlet 226, through the accumulator portion 222, through the fluid exit 228, through the upper fluid passage portion 214, and eventually out through the first open end 218.

Figure 7:
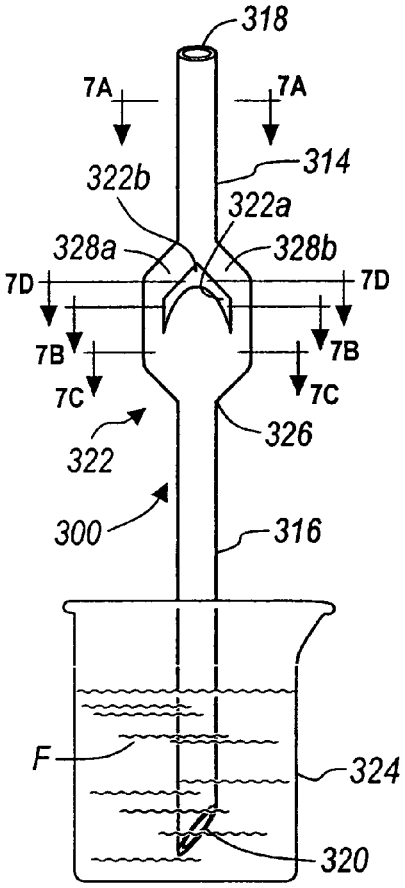
FIG. 7 depicts an elevational view of a third alternative drinking straw, in accordance with a fourth embodiment of the present invention.
Figure 7A:
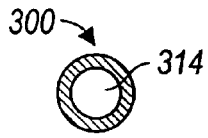
FIG. 7A depicts a sectional view taken along line 7A-7A of FIG. 7.
Figure 7C:
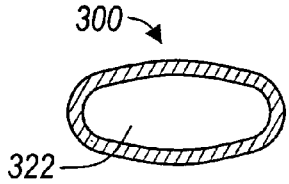
FIG. 7C depicts a sectional view taken along line 7C-7C of FIG. 7.
Figure 7B:
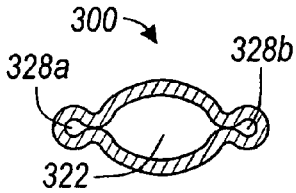
FIG. 7B depicts a sectional view taken along line 7B-7B of FIG. 7.
Figure 7D:
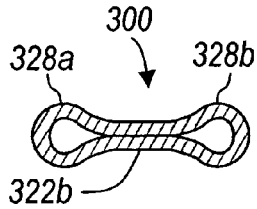
FIG. 7D depicts a sectional view taken along line 7D-7D of FIG. 7.

Referring to FIGS. 7-7D, there is shown a third alternative drinking straw 300, in accordance with a fourth embodiment of the present invention. The straw 300 is somewhat different from the embodiments depicted in FIGS. 1-6D; however, it does share some similar features, such as a an upper fluid passage portion 314, a lower fluid passage portion 316, first open end 318, and second open end 320. The accumulator portion 322 is rather different from the previously described embodiments, as it includes a dome-shaped structure 322*a* opposed from the fluid inlet 326, and a pair of fluid exits 328*a* and 328*b*, respectively. The dome-shaped structure 322*a* is preferably bordered by a baffle member 322*b* formed in the accumulator portion 322. The baffle member 322*b* can be configured in any number of shapes and can be utilized to improve aesthetics such as providing a facial expression such as a smile or the like. Similarly, the accumulator portion 322 can be used as a space for advertising or the like. In accordance with a preferred embodiment of the present invention, the fluid exits 328*a* and/or 328*b* are preferably provided with a relatively equal or smaller cross-sectional profile as compared to the accumulator portion 322. In this embodiment, any upwardly flowing fluid F would have a tendency to strike the surface of the dome-shaped structure 322*a*, as opposed to immediately flowing upwardly through fluid exits 328*a* and 328*b*, respectively.

As with the first two embodiments, the cross-sectional area and/or volume of the accumulator portion 322 is larger than the corresponding cross-sectional area and/or volume of either the lower fluid passage portion 316 and/or the upper fluid passage portion 314.

As with the previously described embodiments, the straw 300 is intended to remove fluid F from a container 324, by having the user apply suction on the first open end 318 so that the fluid F flows upwardly through the second open end 320, into the lower fluid passage portion 316, into the fluid inlet 326, through the accumulator portion 322, through the fluid exits 328*a* and/or 328*b*, respectively, through the upper fluid passage portion 314, and eventually out through the first open end 318.

Figure 8:
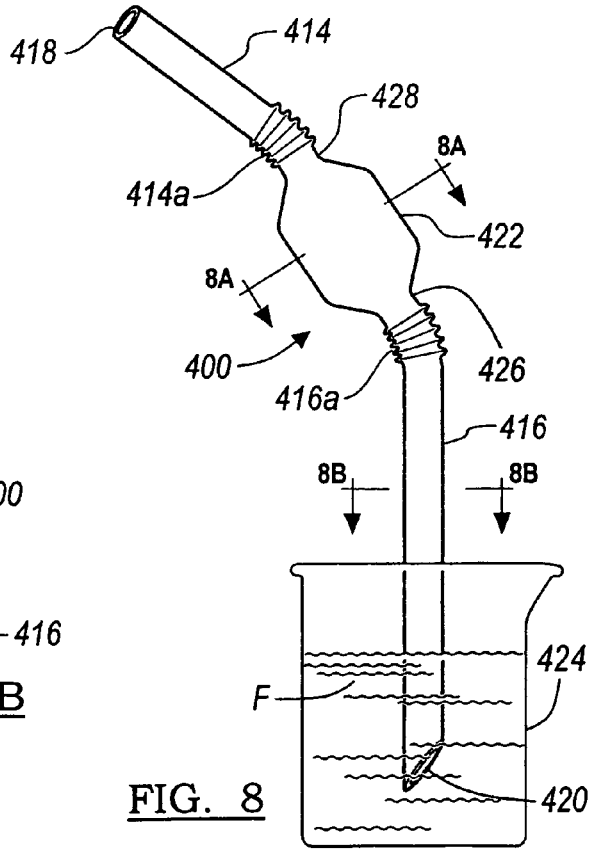
FIG. 8 depicts an elevational view of a fourth alternative drinking straw, in accordance with a fifth embodiment of the present invention.
Figure 8A:
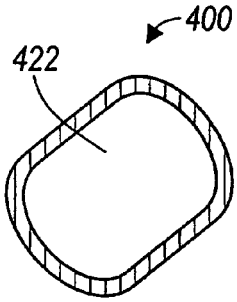
FIG. 8A depicts a sectional view taken along line 8A-8A of FIG. 8.
Figure 8B:
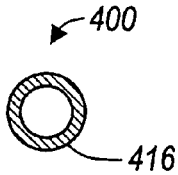
FIG. 8B depicts a sectional view taken along line 8B-8B of FIG. 8.

Referring to FIGS. 8-8B, there is shown a fourth alternative drinking straw 400, in accordance with a fifth embodiment of the present invention. The straw 400 is somewhat different from the embodiments depicted in FIGS. 1-7C; however, it does share some similar features, such as an upper fluid passage portion 414, a lower fluid passage portion 416, first open end 418, and second open end 420. The accumulator portion 422 is somewhat different from the previously described embodiments as it is associated with a fluid inlet 426 and fluid exit 428 that have cross-sectional profiles that are similar to those of the upper fluid passage portion 414 and/or lower fluid passage portion 416. However, the accumulator portion 422, as with other embodiments, has a cross-sectional profile that is equal to or larger than those of the upper fluid passage portion 414 and/or lower fluid passage portion 416. Furthermore, flexible accordion portions 414*a* and 416*a* have been incorporated into the upper fluid passage portion 414 and lower fluid passage portion 416, respectively. The flexible accordion portion can aid in redirecting fluid flow and reducing spillage.

Thus, in this embodiment, any upwardly flowing fluid F would have a tendency to first fill the accumulator 422, as opposed to immediately flowing upwardly through the fluid exit 428.

As with the previously described embodiments, the straw 400 is intended to remove fluid F from a container 424, by having the user apply suction on the first open end 418 so that the fluid F flows upwardly through the second open end 420, into the lower fluid passage portion 416, into the fluid inlet 426, through the accumulator portion 422, through the fluid exit 428, through the upper fluid passage portion 414, and eventually out through the first open end 418.

Figure 9:
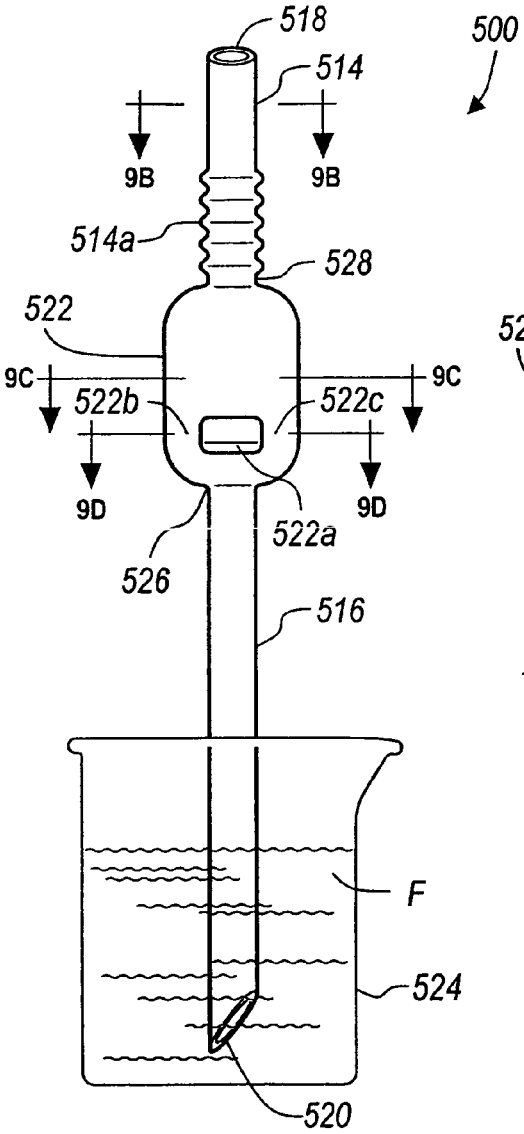
FIG. 9 depicts an elevational view of a fifth alternative drinking straw, in accordance with a sixth embodiment of the present invention.
Figure 9A:
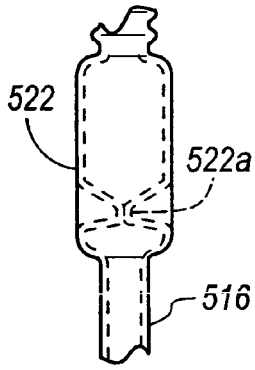
FIG. 9A depicts a fragmentary view of a detailed portion of the drinking straw depicted in FIG. 9.
Figure 9B:
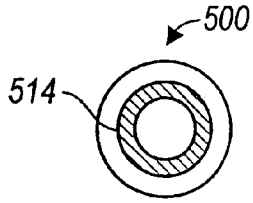
FIG. 9B depicts a sectional view taken along line 9B-9B of FIG. 9.
Figure 9C:
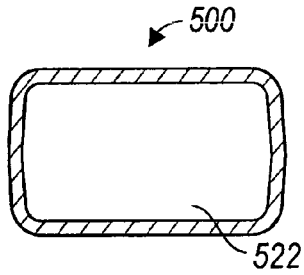
FIG. 9C depicts a sectional view taken along line 9C-9C of FIG. 9.
Figure 9D:
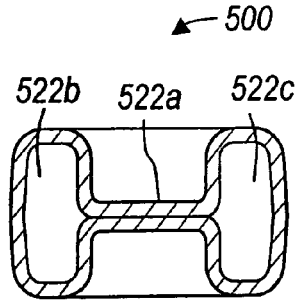
FIG. 9D depicts a sectional view taken along line 9D-9D of FIG. 9.

In accordance with a highly preferred embodiment of the present invention, and referring to FIGS. 9-9D, there is shown a fifth alternative drinking straw 500, in accordance with a sixth embodiment of the present invention. The straw 500 is somewhat different from the embodiments depicted in FIGS. 1-8B; however, it does share some similar features, such as an upper fluid passage portion 514, a lower fluid passage portion 516, first open end 518, and second open end 520. The accumulator portion 522 includes a fluid inlet 526 and fluid exit 528, as well as a baffle member 522*a* formed therein that defines a first accumulator channel 522*b* and a second accumulator channel 522*c*. The baffle members can be any number of configurations. The baffle members can also be used to improve aesthetics. Furthermore, one or more flexible accordion portions 514*a* can be incorporated into the upper fluid passage portion 514 or alternatively, into the lower fluid passage portion 516 (not shown) and/or the accumulator portion 522, or any combination thereof, as set forth above.

Thus, in this embodiment, any upwardly flowing fluid F would have a tendency to first fill the accumulator 522, including the first accumulator channel 522*b* and/or second accumulator channel 522*c*, as opposed to immediately flowing upwardly through the fluid exit 528. This occurs because the fluid is redirected by the baffle and significantly reduces fluid momentum towards the fluid exit 528.

As with the previously described embodiments, the straw 500 is intended to remove fluid F from a container 524, by having the user apply suction on the first open end 518 so that the fluid F flows upwardly through the second open end 520, into the lower fluid passage portion 516, into the fluid inlet 526, through the accumulator portion 522, through the fluid exit 528, through the upper fluid passage portion 514, and eventually out through the first open end 518.

Figure 10:
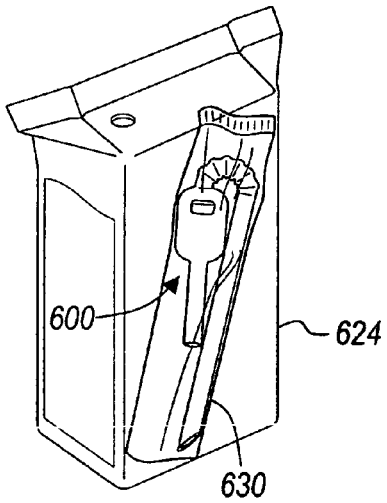
FIG. 10 depicts a perspective view of a drinking straw of the present invention provided with a drinking container, in accordance with a seventh embodiment of the present invention.

Referring to FIG. 10, there is shown a drinking straw 600 of the present invention provided with a drinking container 624 (e.g., a juice pack and the like), in accordance with a seventh embodiment of the present invention. This arrangement can be used for point of sale applications, such as vending machines, cafeterias, grocery stores, convenience stores, restaurants, and the like. The drinking straw 600 can be of any of the aforementioned configurations and can be releaseably secured to the drinking container 624 by any number of methods, including adhesives, adhesive films, adhesive tapes, staples, flaps, slots, grooves, and the like. Furthermore, a protective wrapper 630, such as those comprised of various plastic materials, can be employed to envelope and protect the drinking straw 600 until the user desires to access it. As will be readily understood, any of the embodiments of the present invention may be likewise integrated into the container 624.

Figure 11:
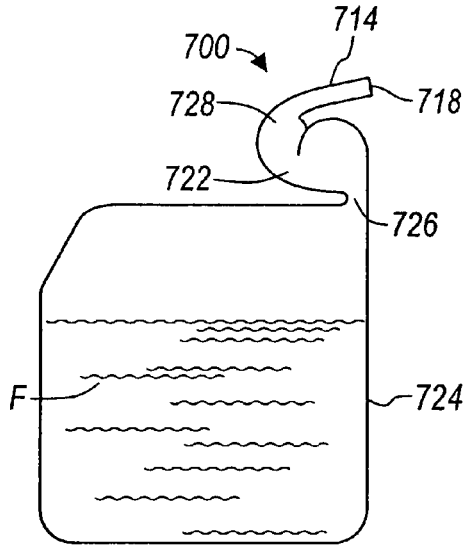
FIG. 11 depicts a sectional view of a drinking container, in accordance with an eighth embodiment of the present invention.

Referring to FIG. 11, there is shown a drinking straw portion 700 integrated into a container 724, in accordance with an eighth embodiment of the present invention. The drinking straw portion 700 includes an upper fluid passage portion 714, an open end 718, an accumulator 722, a fluid inlet 726, and a fluid exit 728. Because of the curved and opposed configuration of the fluid inlet 726 and/or fluid exit 728, any fluid F that is flowing upwardly from the container 724 would tend to fill the accumulator 722 before immediately flowing towards the fluid exit 728, thus providing the container 724 with spill and/or squirt resistance. Of course, to remove the fluid F from the container 724, a user would merely tilt the open end 718 a sufficient amount until the fluid flow (e.g., through the accumulator 722) caused the fluid F to exit the open end 718. As will be readily understood, any of the embodiments of the present invention may be likewise integrated into container 724.

Figure 12:
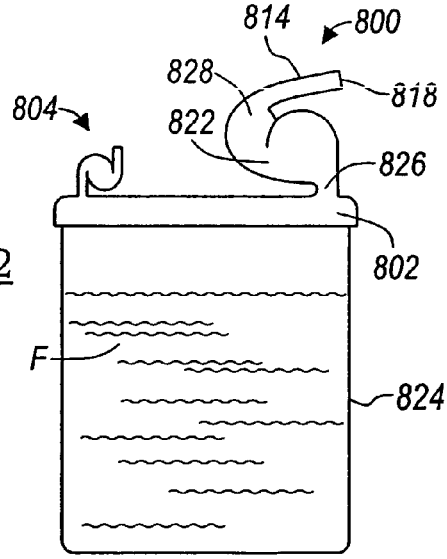
FIG. 12 depicts a sectional view of a first alternative drinking container, in accordance with a ninth embodiment of the present invention.

Referring to FIG. 12, there is shown a drinking straw portion 800 integrated into a lid member 802 that is selectively operable to engage a container 824, in accordance with a ninth embodiment of the present invention. Additionally, the lid member 802 is provided with an optional vent member 804 configured similarly to have a spill resistant accumulator or baffle features such as that described above in the present invention. The drinking straw portion 800 includes an upper fluid passage portion 814, an open end 818, an accumulator 822, a fluid inlet 826, and a fluid exit 828. Because of the curved and opposed configuration of the fluid inlet 826 and/or fluid exit 828, any fluid F that is flowing upwardly from the container 824 would tend to fill the accumulator 822 before immediately flowing towards the fluid exit 828, thus providing the container 824 with spill and/or squirt resistance. Of course, to remove the fluid F from the container 824, a user would merely tilt the open end 818 a sufficient amount until the fluid flow (e.g., through the accumulator 822) caused the fluid F to exit the open end 818. The optional vent member 804 is thought to aid in the flow of fluid F within the container 824 when it is desired to remove the fluid F therefrom and also provide spill resistance. As will be readily understood, any of the embodiments of the present invention may be likewise integrated into the lid 802. Any arrangement for spill resistance set forth herein can be utilized in this embodiment.

Figure 13:
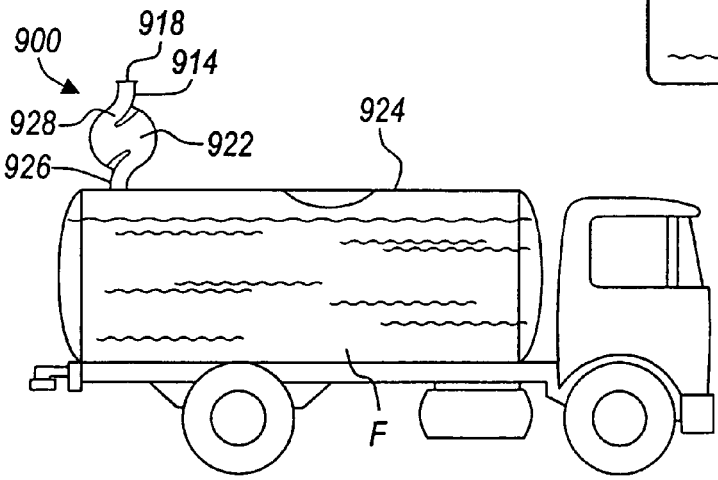
FIG. 13 depicts a schematic view of a vehicle having an accumulator portion, in accordance with a tenth embodiment of the present invention.

Referring to FIG. 13, there is shown a spill/squirt resistant system 900 integrated into a tank 924 (e.g., those used in conjunction with tanker trucks), in accordance with a tenth embodiment of the present invention. The spill/squirt resistant system 900 includes an upper fluid passage portion 914, an open end 918, an accumulator 922, a fluid inlet 926, and a fluid exit 928. Because of the curved and opposed configuration of the fluid inlet 926 and/or fluid exit 928, any fluid F that is flowing upwardly from the tank 924 (e.g., when the truck hits a pothole or dip in the road) would tend to fill the accumulator 922 before immediately flowing towards the fluid exit 928, thus providing the tank 924 with spill and/or squirt resistance. The spill/squirt resistant system 900 also provides an optional way of removing the contents of the tank 924 should conventional means (e.g., valves) fail. As will be readily understood, any of the embodiments of the present invention may be likewise integrated into the tank 924. Any arrangement for spill resistance set forth herein can be utilized in this embodiment.

It should be noted that alternate embodiments of the present invention can be provided with more than one accumulator, can be provided with more than one accumulator entrance, and/or can be provided with more than one accumulator exit, and the like. Furthermore, it will be readily appreciated by one skilled in the art that corrugated sections may be formed anywhere along the apparatus, including but not limited to the upper portion, lower portion and accumulator in a multiple of locations, to improve presentation to a consumer, improve packaging, or improve function. Additionally, the drinking straw of the present invention can be provided with various fluid containers, such as juice packs, to provide a convenient means of accessing the fluid contained therein. Also, while cylindrical straw constructions are shown, other constructions utilizing square, oval, hexagonal or other cross-sectional shapes are also included within the scope of the present invention. These modifications remain within the scope of this invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A straw, comprising:

a first fluid passage portion of said straw having a first open end;

a second fluid passage portion of said straw having a second open end;

a substantially hollow fluid accumulator portion of said straw disposed between, and in fluid communication with, the first and second fluid passage portions, wherein the fluid accumulator portion has a first cross-sectional area;

a fluid inlet disposed between the second fluid passage portion and the fluid accumulator portion, wherein the fluid inlet has a second cross-sectional area; and a fluid exit disposed between the first fluid passage portion and the fluid accumulator portion, wherein the fluid exit has a third cross-sectional area;

wherein the first cross-sectional area is substantially equal to or greater than either the second or third cross-sectional areas;

wherein one of the fluid inlet or the fluid exit are angled with respect to the fluid accumulation portion; and one or more baffles formed on the inside surface of said fluid accumulator portion for directing fluid from said fluid inlet to said fluid exit.

2. The invention according to claim 1, wherein the fluid accumulator portion has a first internal volume, wherein the fluid inlet has a second internal volume, wherein the fluid exit has a third internal volume, wherein the first internal volume is substantially equal to or greater than either the second or third internal volumes.

3. The invention according to claim 1, wherein the fluid inlet and the fluid exit are substantially spaced and diagonally opposed from one another.

4. The invention according to claim 1, wherein the orientation or geometry of the fluid inlet and the fluid exit provide a tortuous path for a fluid flow therebetween.

5. The invention according to claim 1, wherein the orientation or geometry of the fluid accumulator portions provides a tortuous path for a fluid flow therethrough.

6. The invention according to claim 1, wherein the spill or squirt resistant fluid management system is incorporated into a drinking straw.

7. The invention according to claim 1, wherein the spill or squirt resistant fluid management system is incorporated into a fluid container.

8. The invention according to claim 1, wherein the spill or squirt resistant fluid management system is incorporated into a lid member of a fluid container.

9. The invention according to claim 1, further comprising a selectively operable flexible portion incorporated into the group consisting of the first fluid passage portion, second fluid passage portion, the fluid accumulator portion, and combinations thereof.

10. The invention according to claim 1 wherein said one or more baffles form one or more accumulator channels.

* * * * *